United States Patent [19]

Davidson

[11] Patent Number: 4,745,833

[45] Date of Patent: May 24, 1988

[54] APPARATUS FOR CUTTING RECTANGULAR CUTOUTS OF VARYING SIZE FROM A SHEET

[76] Inventor: James A. Davidson, 4300 Laurel Hill Rd., Raleigh, N.C. 27612

[21] Appl. No.: 40,850

[22] Filed: Apr. 20, 1987

[51] Int. Cl.[4] ..... B26D 5/42

[52] U.S. Cl. ..... 83/385; 83/455; 83/456; 83/466; 83/516; 83/560; 83/598; 83/602; 83/618

[58] Field of Search ..... 83/455, 456, 466, 513, 83/516, 519, 374, 382, 385, 598, 560, 602, 618, 620

[56] References Cited

U.S. PATENT DOCUMENTS

| | | | |
|---|---|---|---|
| 371,400 | 10/1887 | Wickham | 83/618 |
| 4,200,429 | 4/1980 | Weil | 425/295 |
| 4,249,437 | 2/1981 | Hagenson | 83/364 |
| 4,505,174 | 3/1985 | Carithers, Jr. | 83/455 |
| 4,641,556 | 2/1987 | Vigneron et al. | 83/455 |
| 4,662,258 | 5/1987 | Mood | 83/455 |

*Primary Examiner*—E. R. Kazenske
*Assistant Examiner*—Scott A. Smith
*Attorney, Agent, or Firm*—Bell, Seltzer, Park & Gibson

[57] ABSTRACT

Frame members of the apparatus mount cutter assemblies that are aligned by relative adjustive movement of the frame members with edges of a cutout that is to be cut from sheet material. The adjustive relative movement of the frame members additionally effects adjustment of the relative positions of the cutter assemblies and associated cam members also carried by the frame members. This in turn causes the cuts made by the cutter assemblies to be of the same length as the therewith aligned cutout edges. The apparatus preferably further includes clamping members that engages the sheet material during each cutting operation, and drive components for imparting desired motions to the various movable components of the apparatus.

19 Claims, 5 Drawing Sheets

APPARATUS FOR CUTTING RECTANGULAR CUTOUTS OF VARYING SIZE FROM A SHEET

FIELD OF THE INVENTION

This invention relates to cutting apparatuses of the type capable of cutting polygonal cutouts of different sizes from an interior portion of sheet material while leaving the border portion of such material intact. The invention more specifically relates to a highly efficient and economical cutting apparatus of the described type that is particularly, although not necessarily exclusively, adapted for cutting photographs, advertisements and the like from the pages of newspapers, magazines or similar sheet material.

BACKGROUND OF THE INVENTION

Advertising agencies, "clipping" services, photographic studios and various other businesses frequently need to cut photographs, advertisements, coupons or other items from paper or similar material such as foil. In some instances it may be necessary or desirable for material within the interior portion of the sheet to be cut therefrom without impairing the integrity of the border of the sheet. Manually performing the cutting operations by use of conventional scissors or knives is tedious and time consuming, and may result in less than satisfactory results such as the formation of ragged or crooked edges.

Certain industrial-type machines are capable of cutting uniform rectangular or other polygonal shapes from the interior of sheet material. Illustrative of these machines are ones for mass-producing picture framing "mats" or passe partouts from cardboard or the like. However, these machines normally possess attributes rendering them less than satisfactory for small business or office use of the type hereinbefore described. They normally are quite expensive and large, and may be difficult and/or dangerous for an inexperienced person to operate. Adjustment of them, for the purpose of changing from a cutout of a first size to one of another size, may be difficult to effect. In most if not all the machines, this requires adjustment of the position of the cutting elements relative to the sheet, and also separate and independent adjustment of the length of the cuts to be made by the cutting elements. While the time required for realization of the foregoing adjustments may not be an important consideration when one is concerned with machines that mass-produce large numbers of mats or the like of standard sizes, it can be a very important consideration when one is dealing with cutouts of many different sizes and limited quantities.

SUMMARY OF THE INVENTION

With the foregoing in mind, the present invention provides an improved apparatus of the hereinbefore described type that is capable of rapidly and neatly cutting polygonal cutouts of differing sizes from paper, plastic, leather, cloth or similar sheet material. The apparatus of the present invention is of safe, compact, economical and durable construction, and is highly efficient in operation. The apparatus includes a plurality of cutting assemblies, and frame means that mount them for rapid adjustive movement into positions of alignment with respective ones of the edges of each particular cutout to be cut from the sheet material. The apparatus further includes means responsive to the aforesaid positional adjustment of the cutting assemblies for automatically correlating the length of the cut made by each cutting means to the length of the therewith aligned one of the edges of the cutout to be cut from the sheet material.

In a preferred embodiment of the apparatus, each cutting assembly includes a substantially fixed cutter blade and a pivotally movable cutter blade cooperable therewith to produce a scissors-like cutting action. The cutting assemblies are preferably carried by frame members that are relatively movable so as to permit rapid adjustment of the positions of the cutting means carried thereby. During each cutting operation, a movable actuating member drives cam members that actuate the cutting assemblies and that undergo movement relative to them during adjustive movement of the frame members. Such relative movement causes the cut produced by each cutting assembly to be correlated with and of the same length as the length of the cutout edge aligned therewith.

DESCRIPTION OF THE PRIOR ART

U.S. Pat. Nos. 371,400, 4,200,429 and 4,505,174 each disclose apparatus for cutting rectangular or other polygonal sections from sheet material. The apparatus of U.S. Pat. Nos. 4,200,429 and 4,505,174 are adjustable so as to produce cutouts of different sizes. The apparatus of U.S. Pat. Nos. 371,400 and 4,505,174 may and apparently do effect simultaneous cutting along each of the edges of the cutouts.

DESCRIPTION OF THE DRAWINGS

Other features of the invention will be apparent from the following description of an illustrative embodiment thereof, which should be read in conjunction with the accompanying drawings, in which.

DESCRIPTION OF THE ILLUSTRATED EMBODIMENT

Figure 1:
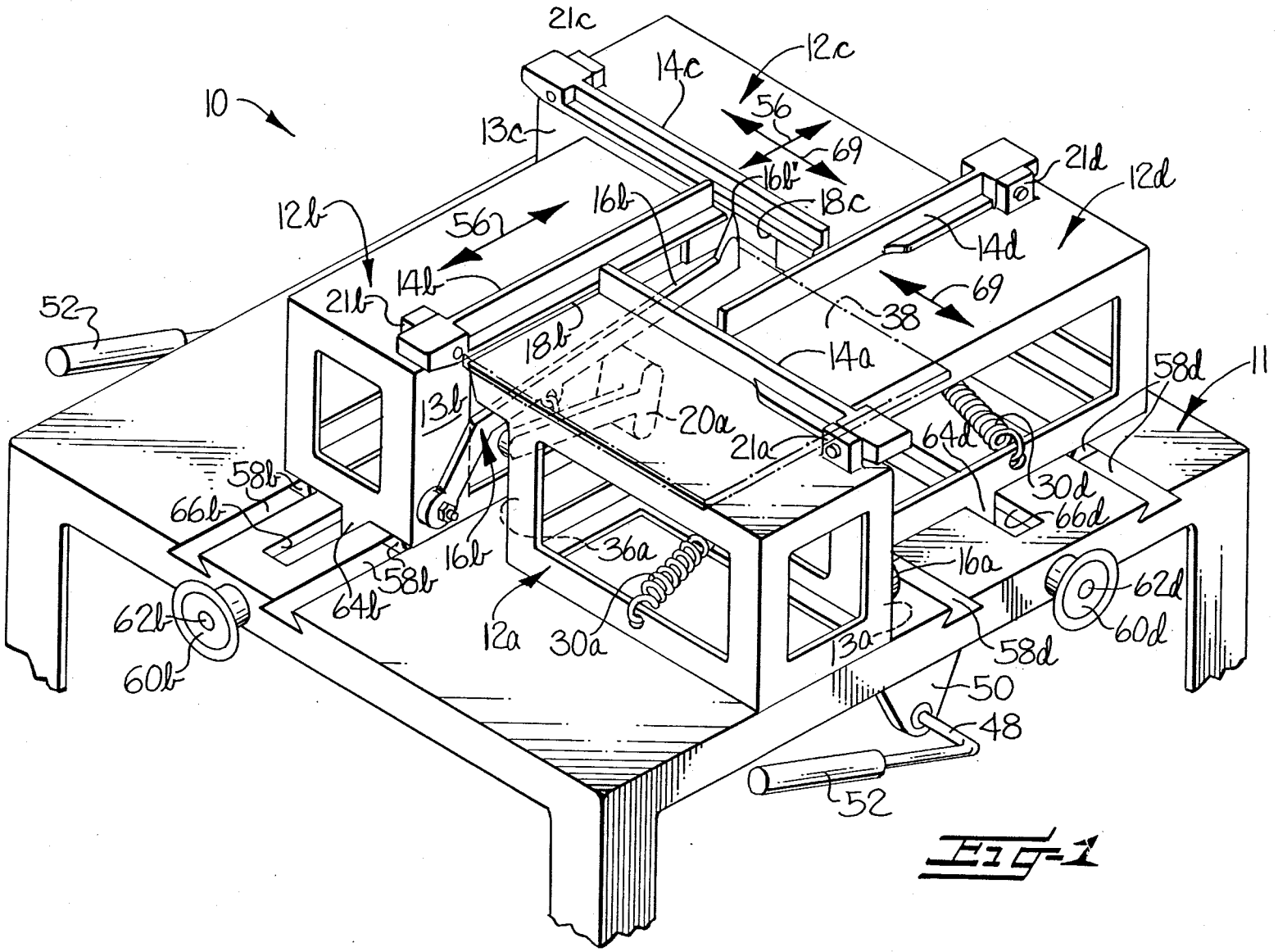
FIG. 1 is a vertically foreshortened perspective view of a cutting apparatus in accordance with the invention.
Figure 2:
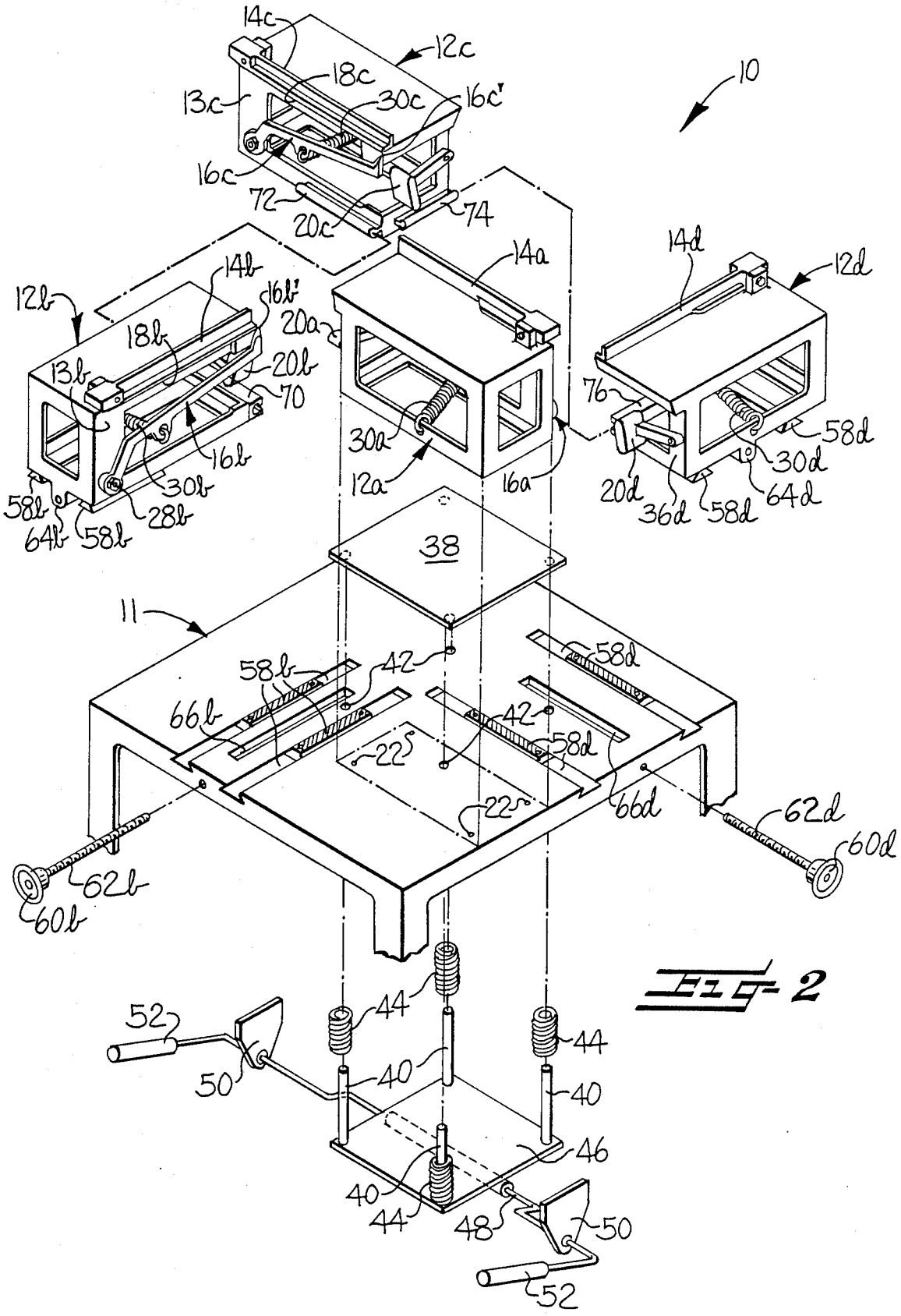
FIG. 2 is a partially-exploded and reduced-scale view of the apparatus of FIG. 1.

The cutter apparatus designated in its entirety in FIGS. 1 and 2 by the numeral 10 has frame means that includes a base 11 underlying and supporting a plurality of relatively movable frame members 12*a*, 12*b*, 12*c*, 12*d*. Frame members 12*a*–12*d* respectively support sheet clamping elements 14*a*–14*d* and cutter assemblies that include movable cutter blades 16*a*–16*d*, and cooperating blades 18*a*–18*d* (FIGS. 9, 10) that are respectively associated with clamping elements 14*a*–14*d*. Apparatus 10 further includes means for effecting adjustment of the relative positions of frame members 12*a*–12*d*; cam means, including a plurality of cam members 20*a*–20*d* for varying the stroke of movable blade elements 16*a*–16*d* in response to changes in the relative positions of frame members 12*a*–12*d*; and actuating means, including actuating levers 52 for effecting actuation of the cutting assemblies at desired times during operation of apparatus 10. The foregoing and other components of the apparatus are described in greater detail hereinafter.

Figure 11:
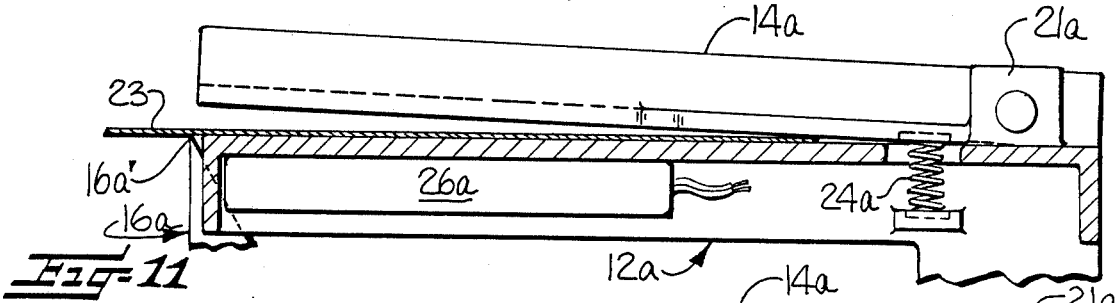
FIGS. 11 and 12 are partially sectional and partially elevational views showing one of the sheet clamping members of the apparatus in its open and closed positions, respectively.
Figure 12:
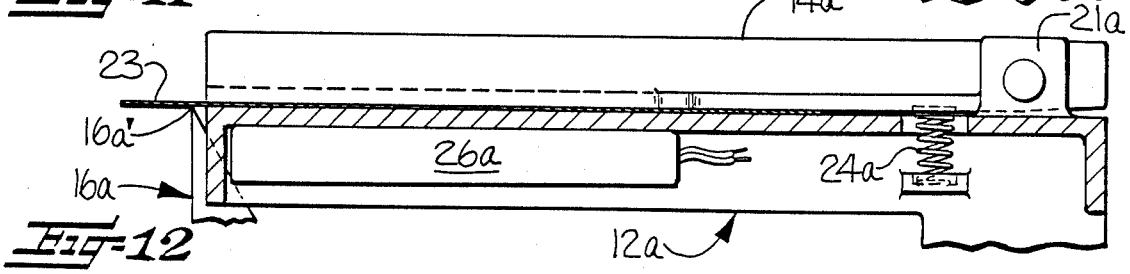

Each of the frame members 12*a*–12*d* of apparatus 10 is of generally rectangular box-like construction and has a central opening in each of its walls other than the top one. Frame member 12*a* is fixedly secured upon the upper surface of base 11 in any suitable manner, as by means of fasteners (not shown) extending thereto through bores 22 (FIG. 2) provided within the base. The sheet clamping element 14*a* of frame member 12*a* is located upon and extends along the solid top wall of frame member 12*a* closely adjacent its juncture with side wall 13*a* thereof. A bracket 21*a* mounts element 14*a* for limited pivotal movement about a horizontal axis adjacent one end thereof. As is best shown in FIGS. 11 and 12, element 14*a* is biased by a spring 24*a* to an elevated or "open" position which facilitates the convenient insertion thereunder of a sheet 23 of paper or similar material to be cut. An electromagnet 26*a* underlies the free end portion of clamping element 14*a* and the sheet-supporting top wall of member 12*a*. Upon actuation of electromagnet 26*a*, the magnetic field produced by it pivots element 14*a* downwardly from its FIG. 11 "open" position to its FIG. 12 "clamping" position wherein the sheet 23 thereunder is clamped against the top wall of member 12*a*. Upon deenergization of electromagnet 26*a*, spring 24*a* returns element 14*a* to its FIG. 11 "open" position.

Figure 9:
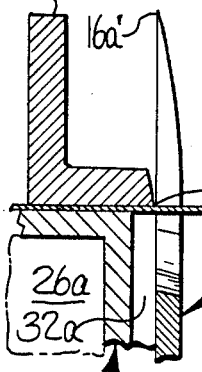
FIG. 9 is an enlarged fragmentary view, primarily in vertical section, illustrating portions of cutting blade and clamping members of the apparatus.

As is best shown in FIG. 9 of the drawings, the cutter blade 18*a* of the two-blade cutting assembly associated with frame member 12*a* is connected to or (as shown) formed integrally with a lower free edge of element 14*a* that overhangs wall 13*a* of frame member 12*a*. As is indicated in FIG. 9, which shows element 14*a* and blade 18*a* in their fixed lowered positions wherein they are retained by electromagnet 26*a* during each cutting operation, blade 18*a* preferably is beveled to facilitate the cutting action of the cutting assembly of which it forms apart. The other blade 16*a* of the aforesaid cutting assembly also has a beveled cutting edge, which extends along the length of its upper surface. Blade 16*a* is pivotally mounted adjacent one end, as by means of a threaded pin 28*a*, upon side wall 13*a* of member 12*a* for counterclockwise (as viewed in FIG. 7) pivotal movement parallel to such wall and along cooperating blade 18*a*. At its free opposite end blade 16*a* has an upstanding pointed portion 16*a*′ that, at the outset of each cutting operation, initially engages and penetrates the overlying sheet 23 (FIG. 9) clamped by clamping member 14*a*. During the remainder of each cutting operation, the point of engagement between blades 16*a*, 18*a* is displaced along the length of blade 18*a*, by the continued counterclockwise pivotal movement of blade 16*a*, causing cutting of the sheet 23 then disposed between the blades. The length of the cut thus made is a function of the extent of the counterclockwise pivotal movement imparted to blade 16*a*. Biasing means, illustratively in the form of a coil spring 30*a* (FIGS. 1 and 2), biases blade 16*a* into firm engagement with the cooperating blade 18*a* during each cutting operation. Spring 30*a* at other times biases blade 16*a* to its inactive position shown in FIGS. 1, 7, wherein the blade engages an underlying stop member 31*a* upon wall 13*a*, and wherein its pointed end section 16*a*′ laterally engages a guide plate 32*a* mounted upon wall 13*a* in underlying and vertically aligned relationship with the adjacent end portion of blade 18*a*. Guide 32*a* ensures that end section 16*a*′ will not, during its initial counterclockwise movement, vertically engage the undersurface of blade 18*a*, rather than passing freely into lateral engagement therewith.

Figure 5:
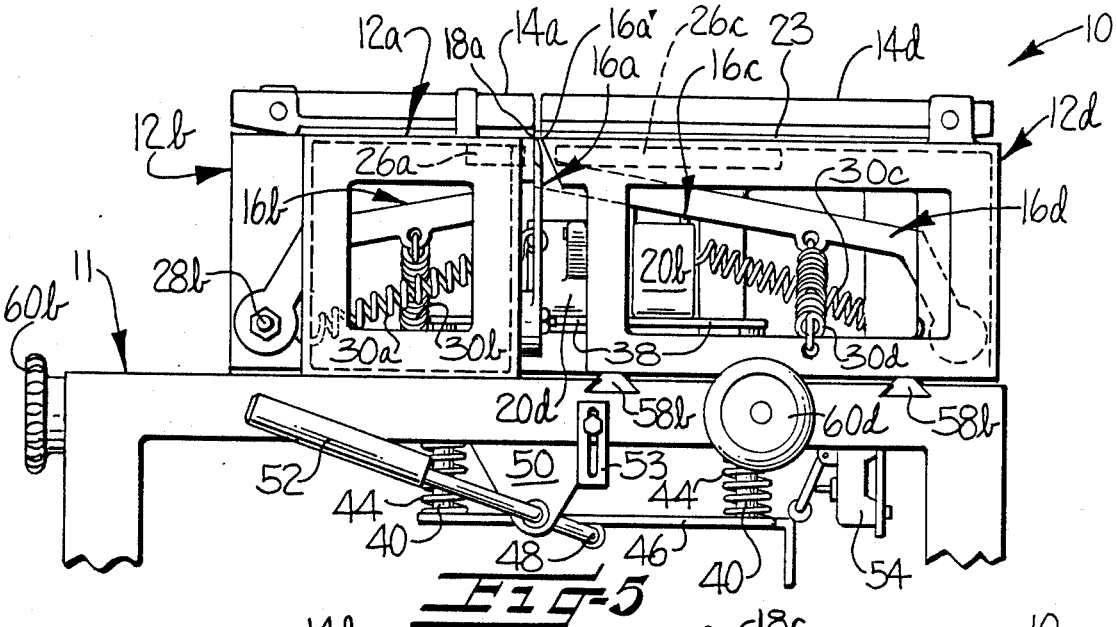
FIG. 5 is a side elevational view of the apparatus as shown in FIG. 4.
Figure 6:
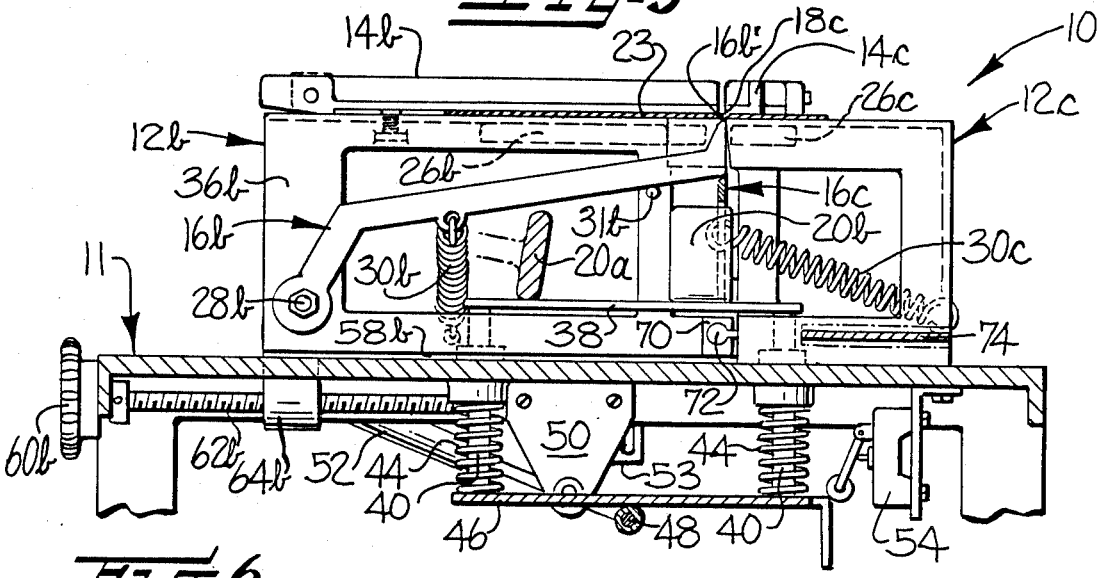
FIG. 6 is a partially sectional and partially elevational view taken generally along the line and in the direction of the arrows 6—6 of FIG. 4.

A cam lever 20*a* (FIGS. 1, 8) is mounted adjacent a slightly recessed end wall 36*a* of frame member 12*a* for pivotal movement parallel to wall 36*a*. The free outer end of lever 20*a* is supportively engaged by a platform 38 mounted upon base 11 of apparatus 10, by means of rods 40 extending through suitable bearing-containing bores 42 within the base, for vertical reciprocatory movement. Platform 38 is normally maintained in its lowered position of FIGS. 5–7 by spring elements 44 that encircle rods 40 and exert downward forces upon a bracket 46 interconnecting the lower ends of the rods. Bracket 46 is underlaid by the central eccentric section of a rod 48 having intermediate sections mounted by bearing-containing brackets 50 of base 11, and having terminal lever-like sections 52 extending angularly therefrom. Operator-induced downward pivotal movement of either actuating lever 52 moves bracket 46 and thus platform 38 upwardly. The extent of each such stroke of upward movement of platform 38 is of a predetermined fixed magnitude that is limited by engagement of bracket 38 with suitable stop means 53 also carried by base 11 of apparatus 10. Initial upward movement of platform 38 and bracket 46 effects actuation of a switch 54 (FIG. 6) that when actuated energizes the magnet 26*a* (FIG. 11) associated with clamping element 14*a*. Switch 54 remains actuated until platform 38 and bracket 46 again return to their lowermost position illustrated in FIG. 6, at which time magnet 26*a* is deenergized by return movement of the switch arm to its illustrated position.

Components identical to those associated with frame member 12*a* are also provided in association with each of the remaining three frame members 12*b*, 12*c*, 12*d* and are designated in the drawings by the same reference numerals and the appropriate letter suffix. In contrast to frame member 12*a*, however, the remaining frame members are mounted upon apparatus base 11 by means, to be now described, permitting adjustive sliding movement of them relative to such base and to one another.

More specifically in the foregoing regard, frame member 12*b* is mounted upon base 11, for the bi-directional movement indicated by the arrows 56 of FIG. 1, by mating tongue-and-groove connectors 58*b* provided upon the undersurface of frame member 12*b* and upon the upper surface of base 11. Adjustive movement in the indicated directions may be easily imparted to member 12*b* either directly or by rotation of a knob 60*b* affixed to a threaded shaft 62*b* mounted upon base 11 by suitable bearings for rotation about its axis, and extending through a threaded lug 64*b* (FIG. 6) extending downwardly from member 12*b* through a slot 66*b* within base 11. The aforesaid mounting arrangement is such that side wall 13*b* of member 12*b* is closely adjacent and parallel to end wall 36*a* of frame member 12*a*, and the free end portion of cam lever 20*a* of member 12*a* underlies and normally is spaced vertically from the inclined cam-like undersurface of cutter blade 16*b* of member 12*b*.

Frame member 12*d* is mounted upon and adjustably movable relative to base 11 by components similar to those described in connection with frame member 12*b* and designated in the drawings by the same reference numerals with a "d" suffix. End wall 36*d* of member 12*d* is closely adjacent and parallel to side wall 13*a* of frame member 12*a*. The outer end portion of cam lever 20*d* of member 12*d* supportively underlies cutter blade 16*a* of member 12*a*. As is indicated by the arrows 69 in FIG. 1, member 12*d* is bi-directionally movable transversely of its length parallel to its end wall 36*d* and parallel to side wall 13*a* of member 12*a*.

The remaining frame member 12*c* has its end wall 36*c* closely adjacent and parallel to side wall 13*d* of member 12*d*; and has its side wall 13*c* closely adjacent and parallel to end wall 36*b* of member 12*b*. The outer end portion of cam lever 20*b* of member 12*b* underlies cutter blade 16*c* of member 12*c*, while cam lever 20*c* underlies blade 16*d* of member 12*d*. Mating slidable connectors 70, 72 respectively affixed to members 12*b*, 12*c* secure the latter member for movement in unison with the former in the direction of the arrows 56 of FIG. 1, while permitting movement of member 12*c* relative to member 12*b* in the direction of the arrows 69. Similar mating connectors 74, 76 secure frame member 12*c* to frame member 12*d* for movement in unison therewith in the direction of the arrows 69 (FIG. 1) while permitting relative movement of member 12*c* in the direction of the arrows 56.

Figure 3:
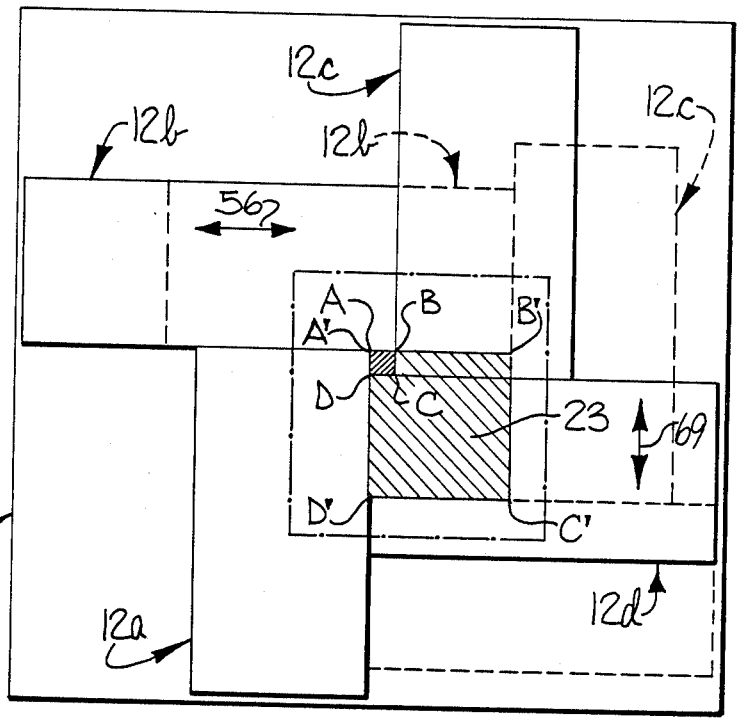
FIG. 3 is a schematic top plan view illustrating the capability of the apparatus for adjustment.

FIG. 3 of the drawing illustrates how apparatus 10 may be employed to cut, from the interior of a sheet 23 of paper or the like, either a relatively small cutout ABCD, or a cutout A'B'C'D' approximately five times larger. Irrespective of the size of the cutout to be produced, the user of apparatus 10 first inserts sheet 23 beneath clamp elements 14*a*–14*d*, aligns one cutout border or edge AD or A'D' with the cutting blade 18*a* of stationary frame member 12*a*, and aligns a second cutout border or edge AB or A'B' with the overlying cutter blade 18*b* of frame member 12*b*. Members 12*b*, 12*c* are then moved in unison with each other in the direction of the arrows 56 (FIG. 1) to align cutter blade 18*c* of member 12*c* with cutout border or edge BC or B'C'; and members 12*d*, 12*c* are moved in unison with each other in the direction of the arrows 69 (FIG. 1) to align cutter blade 18*d* with the remaining edge or border CD or C'D' of the square-shaped cutout. The ease and rapidity with which the foregoing alignments may be made is attributable in part to the fact that the operator has an unobstructed overhead view of the borders of the cutout during the aligning procedure. One or the other of the levers 52 is then depressed to produce an upward stroke of movement of platform 38. During the initial phase of this upward movement actuation of switch 54 (FIG. 6) energizes magnets 26*a*–26*d* and thus causes clamp elements 14*a*–14*d* to clamp sheet 23 against the top walls of members 12*a*–12*d*. The thereafter ensuing continued upward movement of platform 38 raises the thereby supported free outer ends of the cam levers 20*a*–20*d* into engagement with the overlying blades 16*a*–16*d* if, as would usually be the case, they are not already in engagement therewith. The remaining upward movement of platform 38 and levers 20*a*–20*d* then effects substantially simultaneous upward pivotal movement of blades 16*a*–16*d* and cutting of the cutout borders or edges respectively in vertical alignment therewith.

Figure 7:
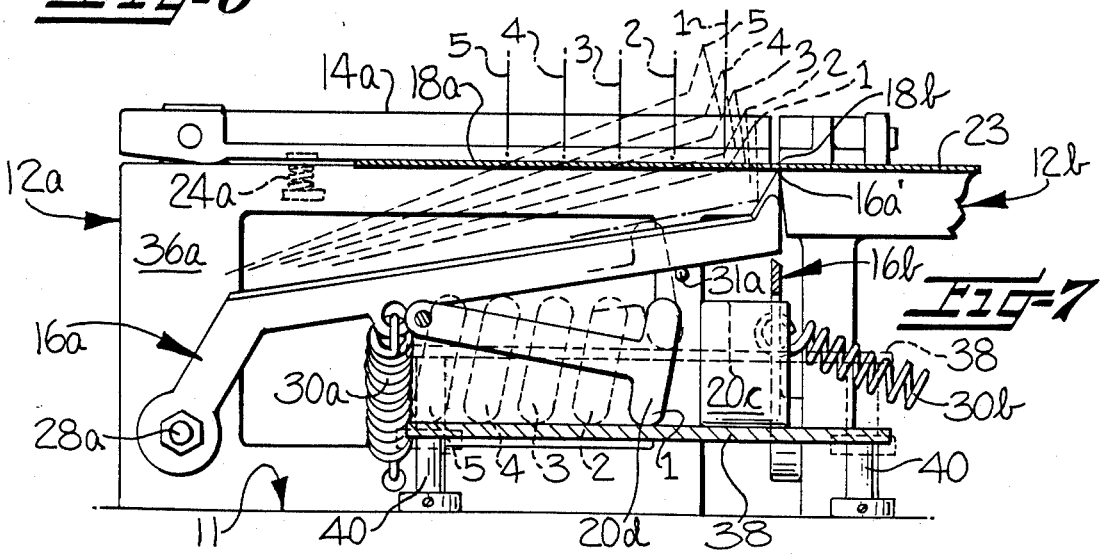
FIG. 7 is an enlarged primarily elevational view, taken generally in the direction of the arrows 7—7 of FIG. 4, illustrating how changes in the relative position of cam member and associated cutter blade change the length of the cutting stroke of the cutter blade.
Figure 8:
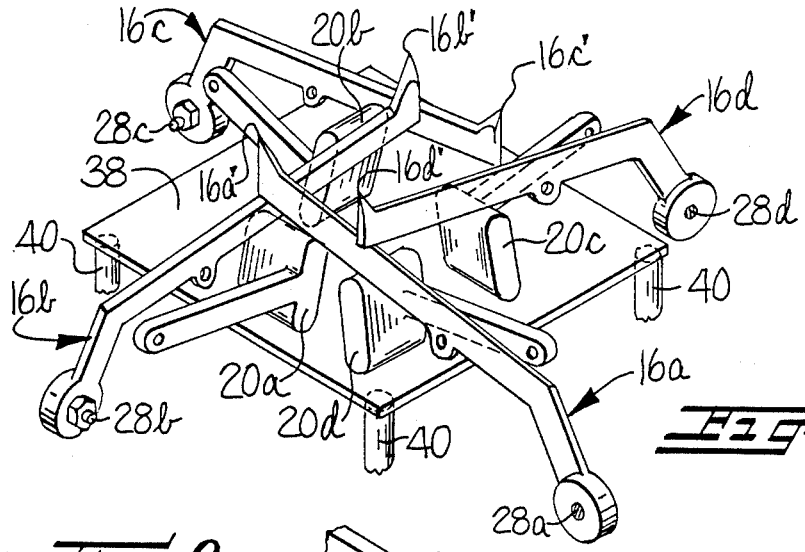
FIG. 8 is a perspective view of cam, blade, and actuator components of the apparatus.

The length of the cut made by the cutting assembly of each of the members 12*a*–12*d* will be equal to the length of the cutout border or edge aligned therewith, irrespective of the size of the particular cutout. This is because the initial adjustment of the relative positions of frame members 12*a*–12*d*, for the purpose of aligning their cutter blades 18*a* with the cutout borders or edges, also simultaneously and automatically effects adjustment of the relative longitudinal and vertical positions of movable cutter blades 16*a*–16*d* and the cam levers 20*d*, 20*a*, 20*b*, 20*c* respectively underlying such blades and engageable with the lower cam surfaces thereof. Such change in relative position varies the extent of the arcuate movement undergone by each blade 16*a*–16*d* in response to upper movement of platform 38, and thus varies the length of the cut made by each blade during the cutting operation. To illustrate the foregoing, let it first be assumed that the cutout to be produced is of the small size ABCD shown in FIG. 3. The "upward" (as viewed in FIG. 3) movement of member 12*d* that is required to align its cutting blades with cutout border or edge DC results in cam lever 20*d* occupying a position, such as that designated by the numeral 1 in the lower part of FIG. 7, relatively distal in a longitudinal direction from the pivot 28*a* of cutter blade 16*a* of member 12*a*, and relatively distal in a vertical direction from the inclined undersurface of such blade. When lever 20*d* and blade 16*a* occupy such relative positions, the upward stroke of movement of platform 38 from its solid line position and to its phantom line position of FIG. 7 causes blade 16*a* to be pivoted upwardly only to its position designated by the numeral 1 in the upper right part of FIG. 7. The resulting cut made in sheet 23 extends only to the line designated by the numeral 1 in the upper central part of FIG. 7. On the other hand, if the larger size cutout A'B'C'D' were to be made, the initial "downward" (as viewed in FIG. 3) adjustive movement undergone by frame member 12*d*, for the purpose of vertically aligning its cutting blades with cutout edge D'C', would displace cam lever 20*d* relative to cutter blade 16*a* such that the lever's free end would occupy the position indicated by the numeral 5 in the bottom portion of FIG. 7. In such position the free end of lever 20*d* is relatively close to pivot 28*a* and to the inclined undersurface of blade 16*a*. The pivotal movement of blade 16*a* resulting from upward movement of platform 38 would then be to the position designated by the numeral 5 in the upper right portion of FIG. 7, and the cut in sheet 26 would extend to line 5. The numerals 2, 3 and 4 in FIG. 7 illustrate three of an infinite number of intervening relative positions of lever 20*d* and cutter blade 16*a* that would ensue when the cutout to be produced is of a size intermediate those shown in FIG. 3. The length of the cutting stroke made by the cutting blades of member 12*d* is similarly varied during initial adjustment between the frame members by displacement of frame member 12*c* and its cam lever 20*c* relative to cutter blade 16*d*. The same result is produced during initial longitudinal adjustment of the positions of frame members 12*b*, 12*c*. However, with such frame members the relative movement between their cutter elements 16*b*, 16*c* and the respective underlying cam levers 20*a*, 20*b* results from longitudinal movement of members 12*b*, 12*c* rather than from lateral movement of the frame members to which the cam levers are affixed. In either case the relative movement occurring during the alignment procedure between the associated blade and cam members does not cause any pivotal blade movement, due to the vertical spacing then present between such members.

Figure 4:
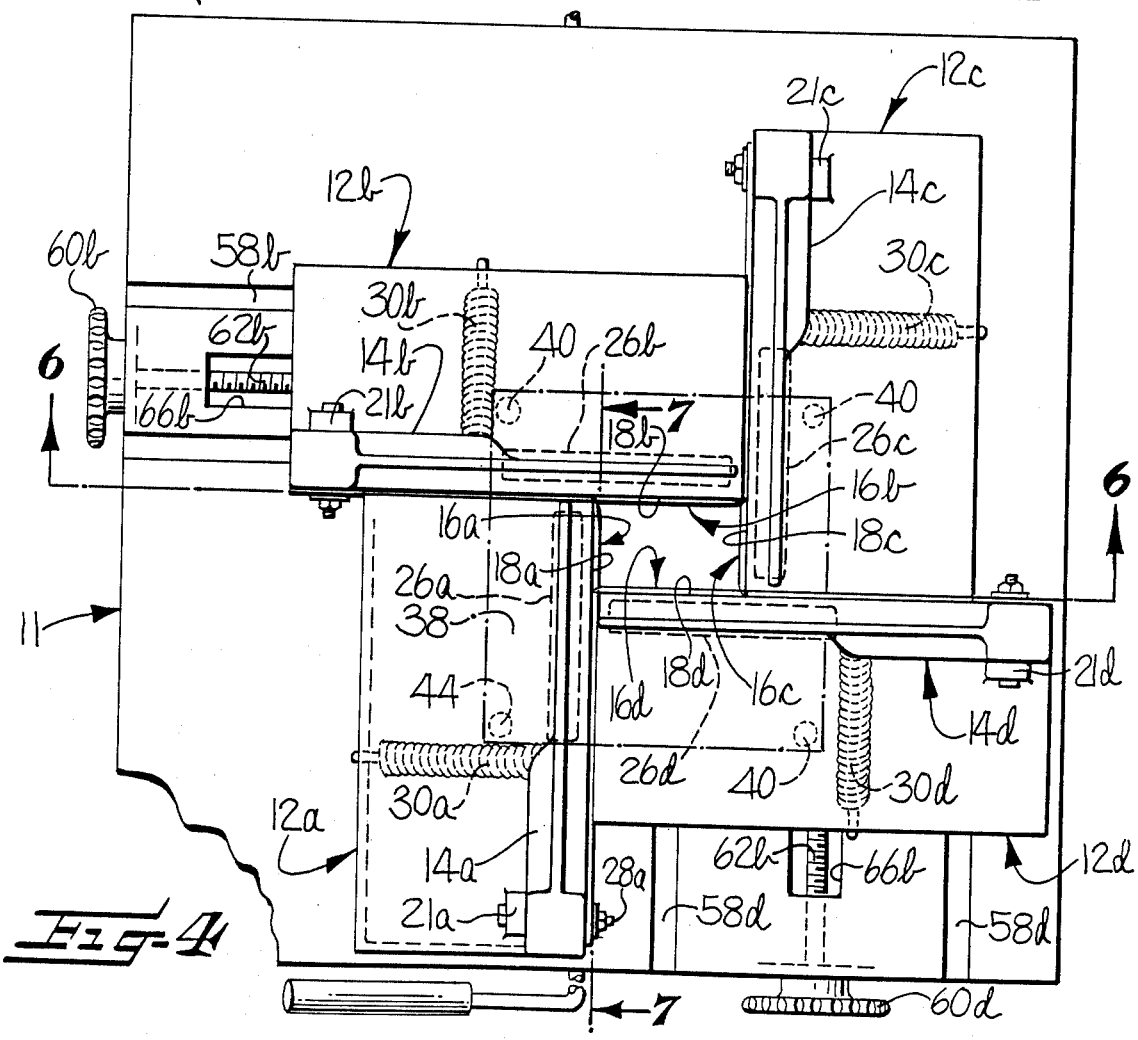
FIG. 4 is a partially broken away top plan view showing the apparatus in an adjustive condition different from that illustrated in FIG. 1.

Instead of the square-shaped cutouts illustrated in FIG. 3 of the drawings, the frame members 12*a*–12*d* of apparatus 10 may be adjusted, with equal ease and as shown in FIG. 4, to produce cutouts of rectangular shape. As in the case of the square-shaped cutouts, the adjustment of frame members 12*a*–12*d* to align their cutting elements with the edges or borders of rectangular cutouts also automatically adjusts the lengths of the cuts produced by the cutting blades of the frame members.

The scissors-type of cutting action between the cooperating cutting blades 16, 18 of each frame member 12 may be and preferably is such as to cause such blades to undergo a self-sharpening action during operation of apparatus 10.

Figure 10:
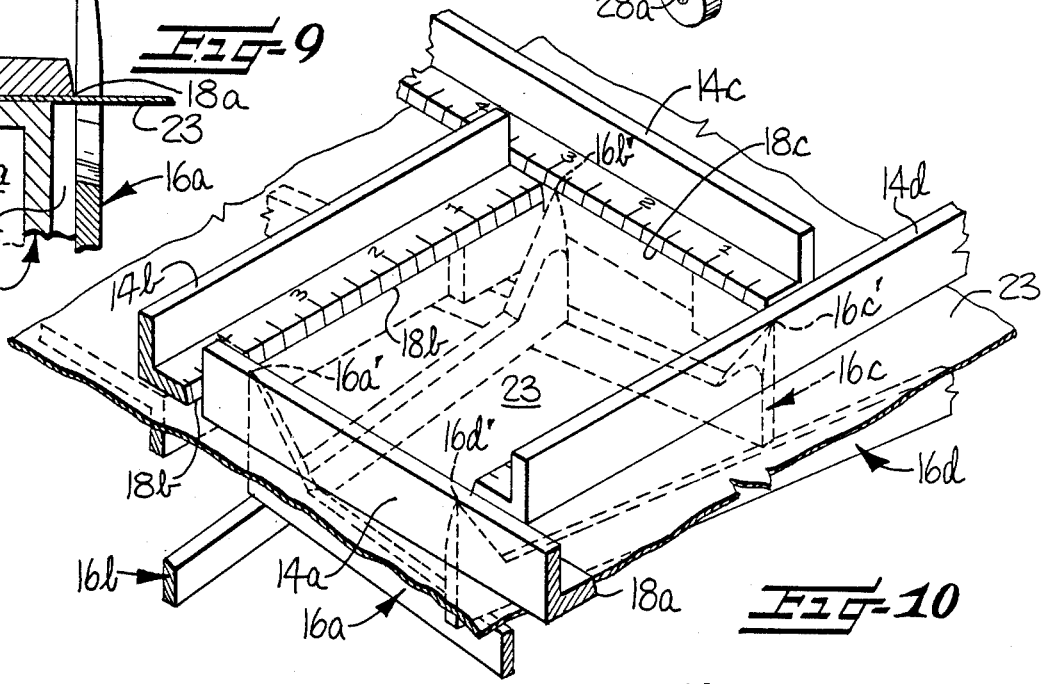
FIG. 10 is a perspective view of cutter blade and clamping members of the apparatus.

As indicated in FIG. 10, measurement indicia may if desired be provided upon clamping elements 14*a*–14*d*.

In addition to its cam-actuating function hereinbefore described, platform 38 serves to support each cutout following its formation and pending its removal from apparatus 10.

While a preferred embodiment of the invention has been specifically shown and described, this was for purposes of illustration only, and not for purposes of limitation, the scope of the invention being in accordance with the following claims.

I claim:

1. Apparatus for cutting polygonal cutouts of different size from sheet material such as paper, comprising:

a plurality of cutting assemblies adapted during operation of said apparatus to make cuts along respective ones of the borders of a cutout to be cut from said sheet material;

frame means mounting at least some of said cutting assemblies for adjustive movement relative to one another in directions facilitating alignment of said assemblies with said cutout borders;

and means responsive to said adjustive movement of said assemblies for automatically correlating the lengths of the cuts made by said assemblies with the lengths of the therewith aligned ones of said cutout borders.

2. Apparatus as in claim 1, wherein said frame means includes a plurality of frame members each mounting corresponding one of said cutting assemblies, each of said cutting assemblies including a first cutting blade mounted in a substantially fixed position upon the associated one of said frame members and a second cutting blade pivotally mounted upon said one of said frame members for pivotal movement relative to and along the length of said first blade.

3. Apparatus as in claim 2, including a base supporting said frame members for adjustive movement of at least first and second ones of said frame members relative to each other and to a third one of members.

4. Apparatus as in claim 3, and further including a fourth one of said frame members, means connecting said fourth frame member to said first frame member for movement therewith in a first direction and for movement relative thereto in a second direction, and means connecting said fourth frame member to said second frame member for movement therewith in said second direction and for movement relative thereto in said first direction.

5. Apparatus as in claim 4, wherein said third frame member is fixedly secured to said base.

6. Apparatus as in claim 1, wherein said means for correlating the lengths of the cuts made by said cutting assemblies includes cam means operatively associated with said cutting assemblies.

7. Apparatus as in claim 6, wherein said cam means includes a plurality of cam members operatively associated with respective ones of said cutting assemblies.

8. Apparatus as in claim 7, wherein said frame means includes a plurality of frame members each mounting one of said cam members and one of said cutting assemblies, and wherein the cam member of each of said assemblies is engageable with the cutting assembly of another of said frame members.

9. Apparatus as in claim 8, and further including actuating means for effecting operation of said apparatus at desired times, said actuating means including an actuating member adapted to undergo movement of substantially constant magnitude during each cycle of operation of said apparatus, said cam members being driven by said actuating member.

10. Apparatus as in claim 9, wherein said frame means includes a base, and said frame members include a first frame member supported by and adjustably movable relative to said base in a first direction, a second frame member supported by and adjustably movable relative to said base in a second direction perpendicular to said first direction, and another frame member supported by said base and connected to said first frame member for movement therewith in said first direction and for movement relative thereto in said second direction, and means connecting said last-mentioned frame member to said second frame member for movement therewith in said second direction and for movement relative thereto in said first direction.

11. Apparatus as in claim 10, wherein said frame members further include an additional frame member fixedly secured to said base.

12. Apparatus as in claim 11, wherein each of said cutting assemblies includes a first generally fixed blade member and a second blade member movable relative to and along the length of said first blade member.

13. Apparatus as in claim 12, wherein said first blade members of said cutting assemblies overlie said second blade members prior to commencement of each cutting operation of said apparatus.

14. Apparatus as in claim 13, including means for biasing said second blade members of said cutting assemblies laterally toward respective associated ones of said first blade members.

15. Apparatus as in claim 14, and further including clamping means engageable during each cutting operation of said apparatus with said sheet material.

16. Apparatus as in claim 15, wherein said clamping means includes a plurality of clamping members each movable between an open position and a clamping position, biasing means for biasing said clamping members toward said open positions thereof, and electromagnetic means for moving said clamping members to said clamping positions thereof.

17. Apparatus as in claim 16, wherein said first blade elements of said cutting assemblies are carried by said clamping members.

18. Apparatus as in claim 17, and further including means for energizing said electromagnetic means at the outset of each cutting operation of said apparatus.

19. Apparatus as in claim 18, and further including drive means connected to said first frame member and to said second frame member for imparting movement thereto in said first direction and in said second direction.

* * * * *